US010753655B2

(12) United States Patent
Kelley

(10) Patent No.: US 10,753,655 B2
(45) Date of Patent: Aug. 25, 2020

(54) ENERGY RECYCLING HEAT PUMP

(71) Applicant: William A Kelley, Austin, TX (US)

(72) Inventor: William A Kelley, Austin, TX (US)

( * ) Notice: Subject to any disclaimer, the term of this patent is extended or adjusted under 35 U.S.C. 154(b) by 1371 days.

(21) Appl. No.: 14/673,462

(22) Filed: Mar. 30, 2015

(65) Prior Publication Data

US 2015/0192333 A1 Jul. 9, 2015

(51) Int. Cl.
*F25B 27/00* (2006.01)
*F25B 11/02* (2006.01)

(52) U.S. Cl.
CPC ..... *F25B 27/00* (2013.01); *F25B 11/02* (2013.01)

(58) Field of Classification Search
CPC ..... F25B 27/00; F25B 11/02
USPC ..... 62/238.7
See application file for complete search history.

(56) References Cited

U.S. PATENT DOCUMENTS 4,009,587 A * 3/1977 Robinson, Jr. ..... F25B 1/00 62/116
4,170,116 A 10/1979 Williams
4,342,200 A * 8/1982 Lowi, Jr. ..... B60H 1/00007 417/191
4,350,571 A 9/1982 Erickson
4,809,521 A 3/1989 Mokadam
5,524,442 A * 6/1996 Bergman, Jr. ..... F25B 9/004 62/86
6,199,387 B1 * 3/2001 Sauterleute ..... B64D 13/06 62/87
6,212,892 B1 4/2001 Rafalovich
6,247,323 B1 6/2001 Maeda
6,604,378 B2 8/2003 Clodic
6,640,567 B2 11/2003 Kim et al.
6,672,082 B1 1/2004 Maeda et al.
6,941,763 B2 9/2005 Maeda et al.
8,915,092 B2 12/2014 Gerber et al.
2003/0021701 A1 * 1/2003 Kolodziej ..... F04D 25/163 417/243
2007/0101755 A1 * 5/2007 Kikuchi ..... F16C 33/74 62/402
2010/0028195 A1 2/2010 Maeda et al.
(Continued)

OTHER PUBLICATIONS

"Turboexpander"; Wikipedia; https://web.archive.org/web/20130719081122/https://enwikipedia.org/wiki/Turboexpander; Jul. 19, 2013; 6 pages.

*Primary Examiner* — Steve S Tanenbaum

(57) ABSTRACT

A set of devices that can leverage creating small volume changes with small amount of work to create larger heat energy temperature differences, recycle a portion of the compression energy equal to approximately the ratio of the absolute temperature of the cooled space to the heated space, and recycle the heat energy to reduce or eliminate the effect of the temperature gap between the cooled space and heated space. Piston, rotary and turbine based devices are disclosed to achieve the recycled compression energy, for systems designed with single phase vapor or air working fluids. System configuration with counterflow heat exchanger disclosed to recycle the energy needed to cross the temperature gap, applicable both to air/vapor systems and to Freon/refrigerant 2 phase systems. Resulting single phase systems can operate over entire temperature range of Earth's surface and are not limited to constrained temperature range of refrigerant phase change.

22 Claims, 13 Drawing Sheets

(56) References Cited

U.S. PATENT DOCUMENTS

| | | | | |
|---|---|---|---|---|
| 2010/0139297 | A1* | 6/2010 | McCormick | F25B 9/004 62/89 |
| 2010/0275616 | A1* | 11/2010 | Saji | F25B 9/06 62/6 |
| 2010/0275634 | A1* | 11/2010 | Okamoto | F25B 31/004 62/324.6 |
| 2012/0180505 | A1 | 7/2012 | Gerber et al. | |
| 2012/0247734 | A1 | 10/2012 | Kelley | |
| 2013/0168225 | A1 | 7/2013 | Oikimus et al. | |
| 2013/0180270 | A1* | 7/2013 | Lemieux | F25B 9/06 62/86 |
| 2014/0298847 | A1 | 10/2014 | Kelley | |
| 2014/0311167 | A1* | 10/2014 | Hugenroth | F25B 9/06 62/6 |
| 2015/0143828 | A1 | 5/2015 | Atalla | |
| 2015/0192333 | A1 | 7/2015 | Kelley | |
| 2016/0161158 | A1 | 6/2016 | Gill | |
| 2016/0265545 | A1* | 9/2016 | Ueda | F04D 29/083 |

* cited by examiner

ENERGY RECYCLING HEAT PUMP

CROSS-REFERENCE TO RELATED APPLICATIONS

None.

STATEMENT REGARDING FEDERALLY SPONSORED RESEARCH AND DEVELOPMENT

This patent is not federally sponsored.

REFERENCE TO SEQUENCE LISTING, A TABLE, OR A COMPUTER PROGRAM LISTING COMPACT DISC APPENDIX

Not applicable.

BACKGROUND OF THE INVENTION

Refrigeration and heat pump systems use large amounts of energy and have limited range of temperature difference between the heat source/heat sink and the air or vapor being cooled or heated. They have inherent limits of temperature range because of use of phase change to achieve temperature shift. They also suffer from a "dead band" of wasted energy to create a temperature shift large enough to bridge the gap between the refrigerated side and the heated side. Freon 410 systems have a Coefficient of Performance (COP) which is the amount of energy pumped divided by the work energy which must be added. For heating applications the work energy is included in the heat output, so in general the COP for cooling plus 1 equals the COP for heating.

Refrigerant based heat pumps are used primarily for historical reasons, as equipment and methods exist to create a purely gas phase heat pump. Additionally, to use a gas phase heat pump requires removing energy on the cooled side before heat exchange. That has been assumed to be a liability, as it is mistakenly assumed that removing energy requires expenditure of energy. However, this energy is actually readily available to help compress the vapor to required pressure for the hot side of the cycle, producing a net reduction in expended energy.

BRIEF SUMMARY OF THE INVENTION

Heat pump systems typically move more energy than they take to operate. Rather than state efficiencies over 100%, it is customary to refer to the efficiency of heat pump systems in terms of Coefficient of performance or (COP) for short.

The disclosed devices are applicable to all types of heat pump systems, air conditioning, heating air, water or other material via heat pump, refrigeration systems such as refrigerators, freezers or ice making devices. Consider any device mention below as placeholder for any such device.

Vapor pressure varies with volume by a negative exponent of a constant determined by the specific heat of the vapor called gamma. For air, gamma is 1.4. Vapor Temperature varies by a related constant Beta, equal to gamma minus 1. For air, beta is approximately 0.4. Temperature (or relative heat energy)=k*Volume$^{-0.4}$. Gamma for Freon 410, used for comparison is 1.21, according to Patent US20100281915. So Freon actually requires more external work energy to be added to cross the temperature gap between cold and hot side heat exchangers.

Two methods of recycling are disclosed. One, gap energy recycling, recycles the energy to cross the temperature gap (the gap between the heated space temperature and the cooled space temperature). This almost eliminates the energy penalty for pumping energy from a cold space or object to a heated space or object with increasing temperature differences.

The second method disclosed is pressure difference energy recycling. It recognizes that in a closed gas phase system (which is presumably air in building temperature control applications) has an easily available reverse work operation that can assist in providing a portion of the work necessary to compress the hot side vapor. This method is applicable to all-gas-phase systems, not liquid/gas phase change systems.

Pressure difference term is used to describe the mechanism of recycling. The pressure difference allows for a symmetrical energy recovery, by using a device to perform work as the high pressure working fluid is conveyed to the low pressure side (as opposed to a simple constriction in flow, which would create a pressure difference but not allow any energy to be removed. that would be an isentropic case.) In all cases disclosed, recycled energy is heat. The device for expansion work and compression work should be similar in type, and the force of the expansion work conveyed directly to assist the compression work via mechanical, electrical, hydraulic or other energy conveying method.

The systems discussed have two approximately uniform zones of pressure, one high and one low. The energy available to recycle depends on the volume of material (not mass) that flows between low and high pressure; or Pressure time Volume change. In an ideal system, which was not dissipating any heat on the hot side, the volumes of material would be the same, and once operating would consume no energy (and move no heat). In real systems, the volume of a unit mass of material is smaller after being cooled off. If 1 unit mass is 1 unit volume after compression, cooling it off at constant pressure reduces its volume by the ratio of the absolute temperatures. A 27 C/300 K ambient cool side, with a 5% higher temperature hot side will have a temperature of about 315 K or 42 C. The action of compression will increase temperature of the working fluid, in the graphed examples by about 15% or 345 K. This is the point at which we defined the unit mass and unit volume. After cooling down in the hot side heat exchanger, the temperature will drop to 315 Kelvin, or about 10%. Therefore the work the cool side pressure difference can accomplish is about 10% less than the compression work, so an ideal system would expend only 10% of the compression energy, and recycle 90% of the compression energy. As the temperature drop falls to 0%, the recycled energy in an ideal system approaches (does not reach) 100% of amount needed to perform compression. So the COP of the system is highly variable (but always greater than non recycling systems), and approaches infinity as smaller and smaller amounts of heat need to be moved.

Additionally, the ratio of the added work to the pumped heat approaches 0% as smaller amounts of heat are moved, also causing the COP to increase and energy expenditure (energy of compress minus energy of air motor expansion) to approach 0. This effect and the pressure difference recycling are multiplicative, so the ideal COP increases quadratically as the amount of heat pumped per unit time decreases. System designs which can run continuously at lower rates of heat movement will be more efficient than systems which turn off and on, pumping large amounts of heat. Although the opposite effect, pumping larger quantities of heat will decrease efficiency quadratically, the ideal efficiency is always greater for the air system with pressure difference recycling than the Freon system, because recycling any of the compression energy results in lower energy expenditure than not recycling any. Once the pressure difference recycling becomes negligible the COP drop slows to linear as higher heat quantities per unit time are moved.

Disclosed are several varieties of pressure difference energy recycling devices, piston based, turbine/compressor wheel based, and rotary compressor based.

Disclosed are configurations for cooling, heating, and switchable applications.

Disclosed are means of retrofit the gap recycling method into existing refrigerant systems.

Disclosed are ideal performance characteristics (COP) of 4 configurations. Also, for the two more efficient systems, a range of efficiency based on existing turbine/compressor wheel rotary air compression and energy converting decompression, using isentropic efficiency typical for moderate and high efficiency devices. This achievable energy efficiency range is plotted on the two gas phase graphs, showing the calculated efficiencies using existing technology far exceeds the best theoretical efficiency of refrigerant based systems.

For Freon 410, based on patent US 20100281915 A1, gamma for that gas is 1.21. This means that about twice the energy must be added to the Freon 410 for a given temperature change, as compared to air. The work to accomplish this is represented by an approximately triangular area on a pressure-volume graph. The area of the triangular shaped area is approximately Pressure-difference times volume-difference times 0.5, or half the rectangular region. Since both the pressure and volume differences approximately double relative to air systems, the energy expended to cross the temperature gap between cooled space and heated space by Freon systems is about 4 times the energy expended on air systems.

BRIEF DESCRIPTION OF THE FIGURES

Figure contents:

FIGS. 1, 2, 3 and 4 have full vertical scale of 10 COP.

Graphs labels in drawings are as follows:

Numbers represent scale, horizontal or vertical.

FIGS. 1-7 are plots vs relative volume as horizontal axis, where unit volume is chosen at minimum density for maximum unit volume of unit mass.

Vertical scales are multiple of heat energy moved per mechanical work added for all COP curves.

For temperature curves FIGS. 1-6, scale is given by 3=300 Kelvin.

Figure 7:
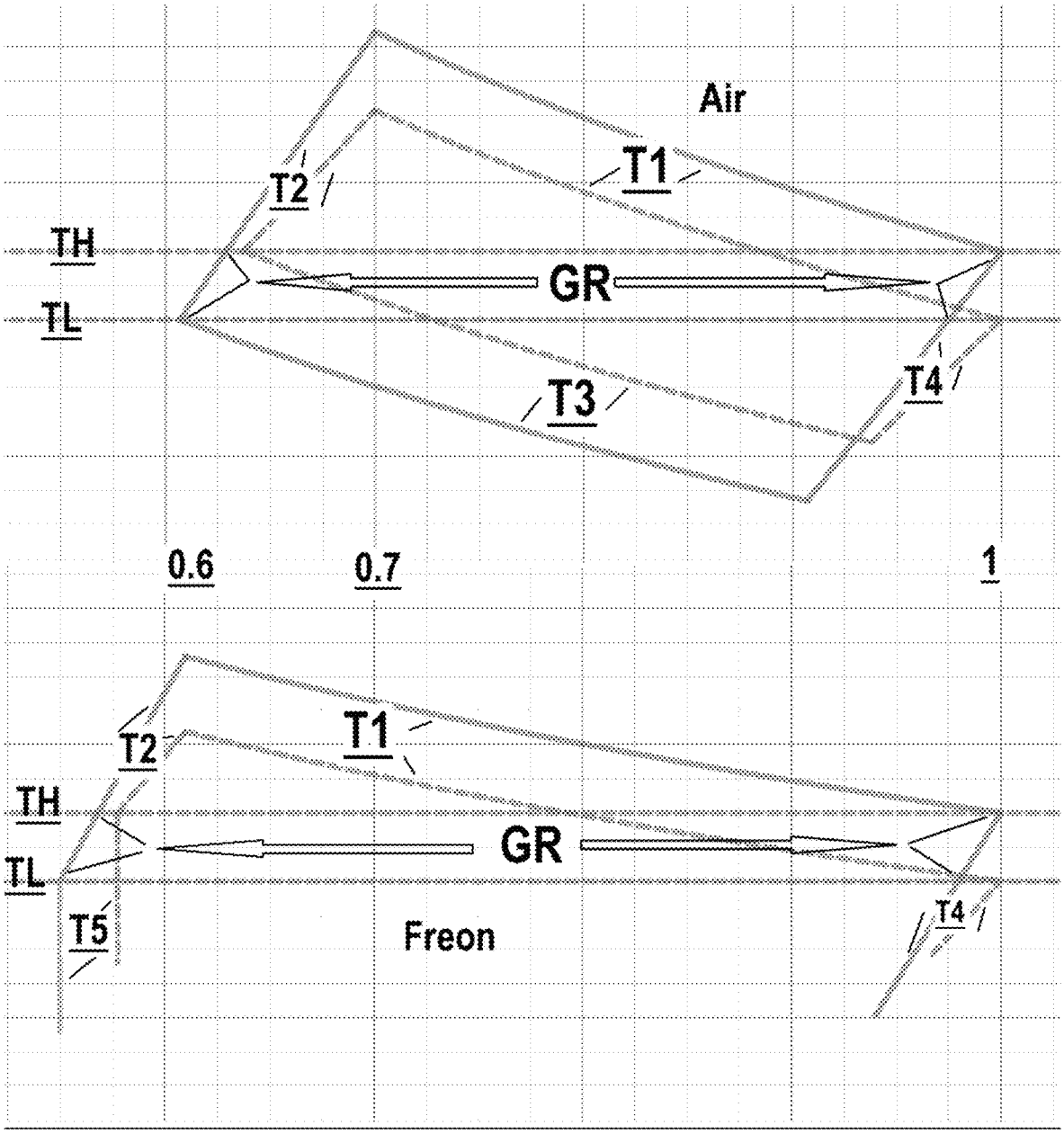
FIG. 7 shows the temperature vs. volume plots for FIG. 1 thru 4, with cool side set at 1 and other temperatures relative to the cool side temperature. Solid lines denotes with recycling, dashed without.

For temperature curves in FIG. 7, 1 represents the cold side ambient, and other temperatures are relative to that temperature.

Figure 8:
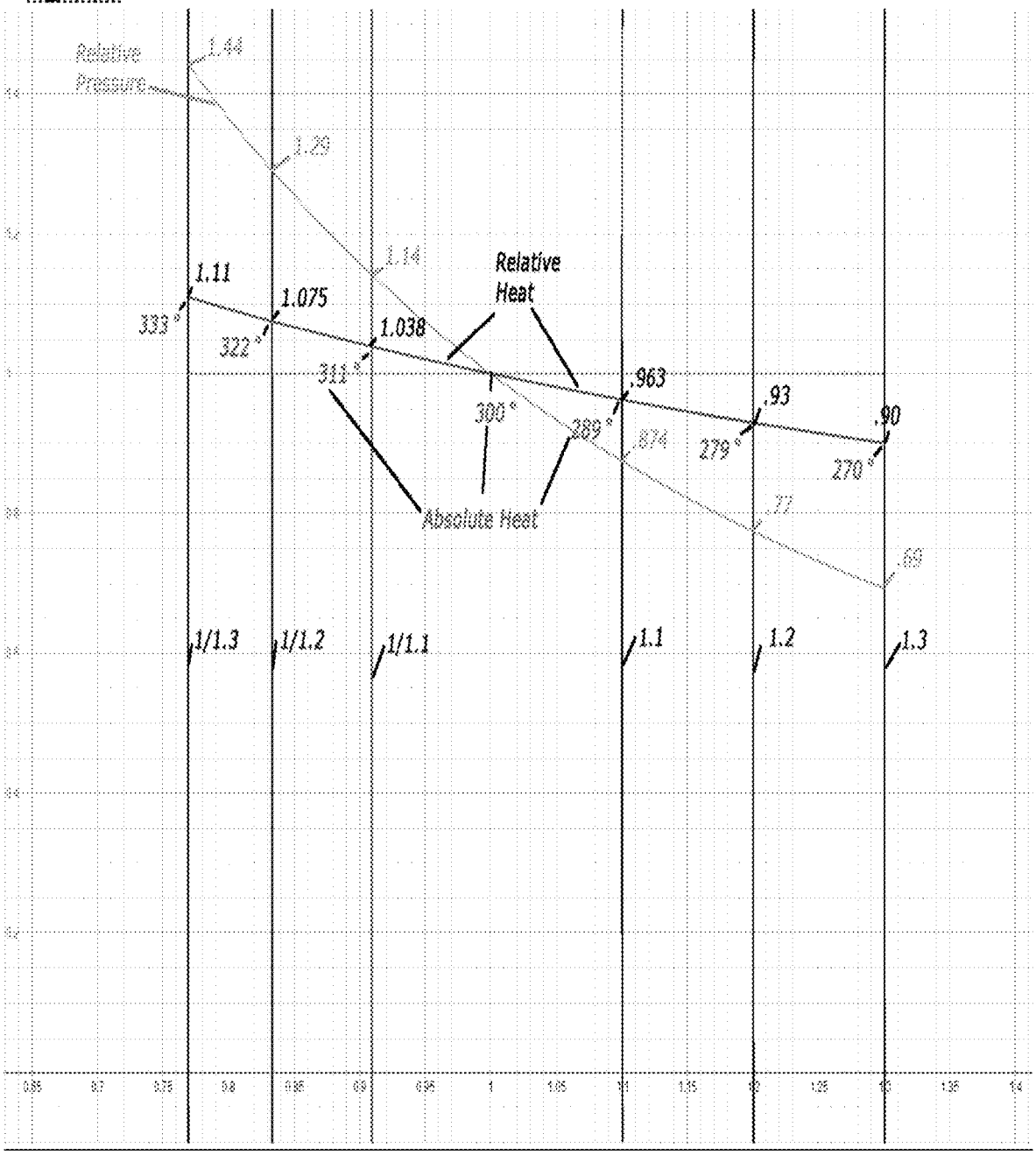
FIG. 8 shows behavior of air and other gases under small changes in volume, creating changes in pressure and temperature.
Figure 9:
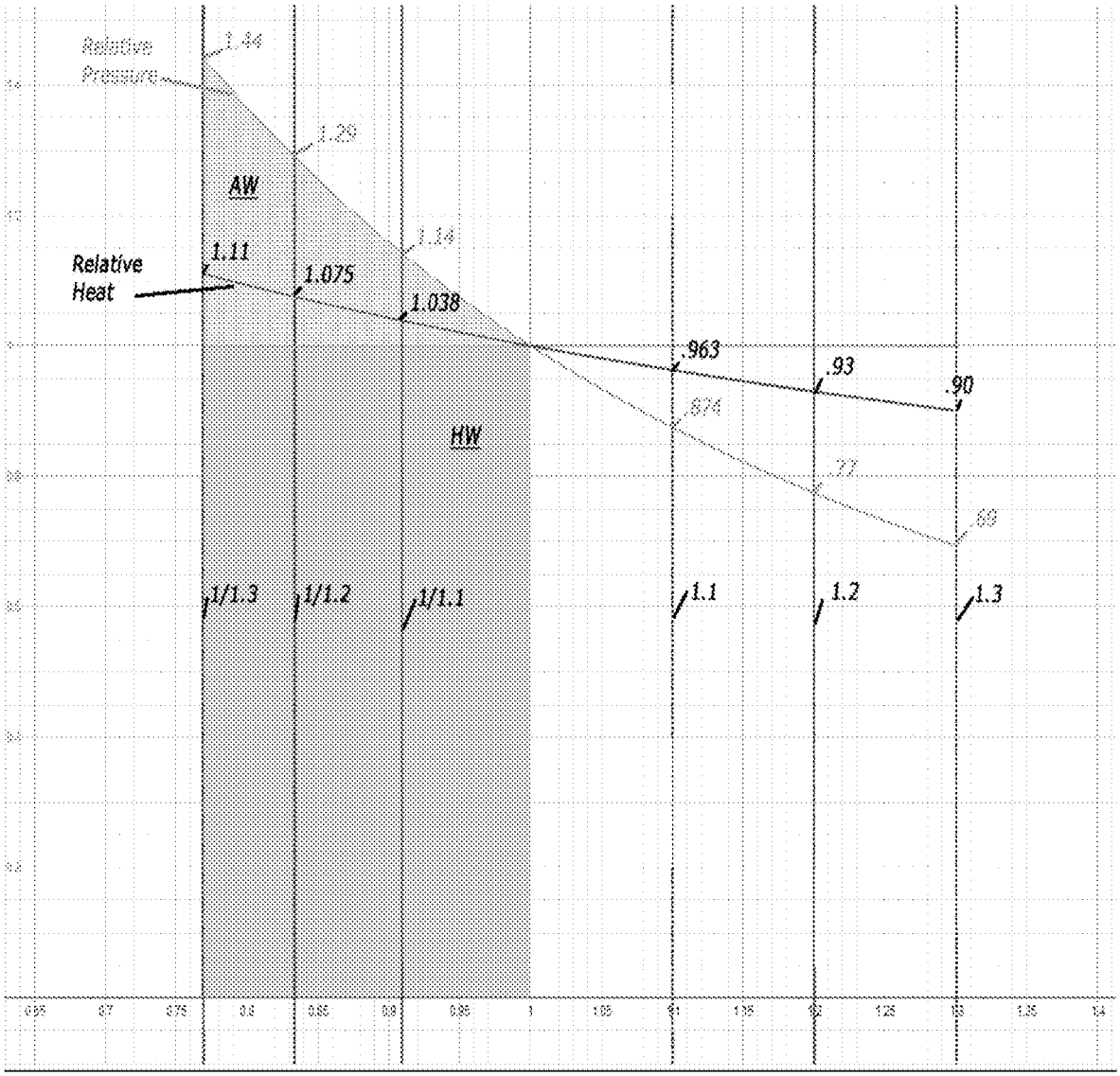
FIG. 9 shows ratio of work to heat increase for compressed gases.
Figure 10:
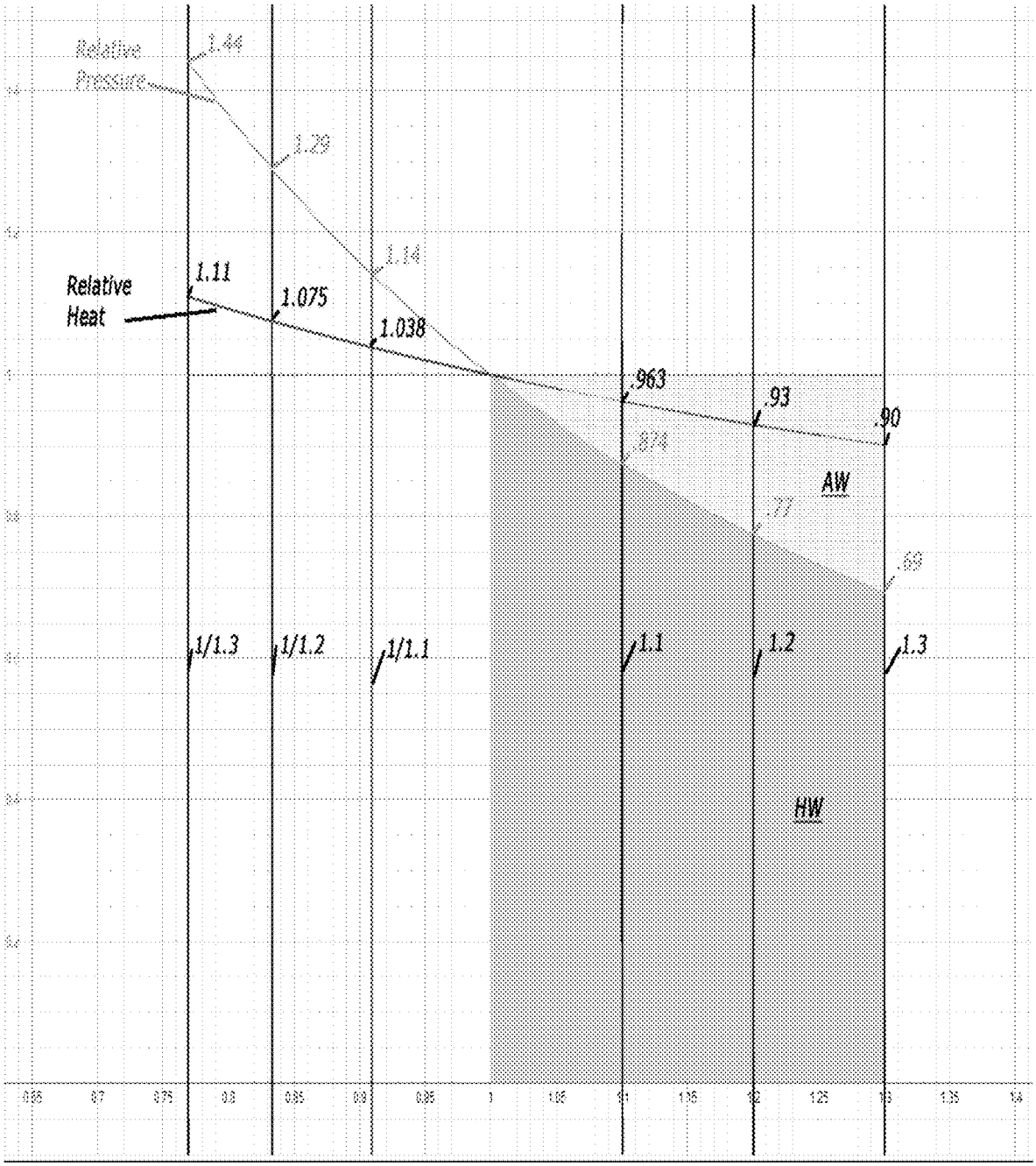
FIG. 10 shows ratio of work to heat decrease for expanded gases.

For graphs in FIG. 8 thru 10, curves are labeled and numeric values marked for relative volume, relative pressure, and relative heat.

Figure 5:
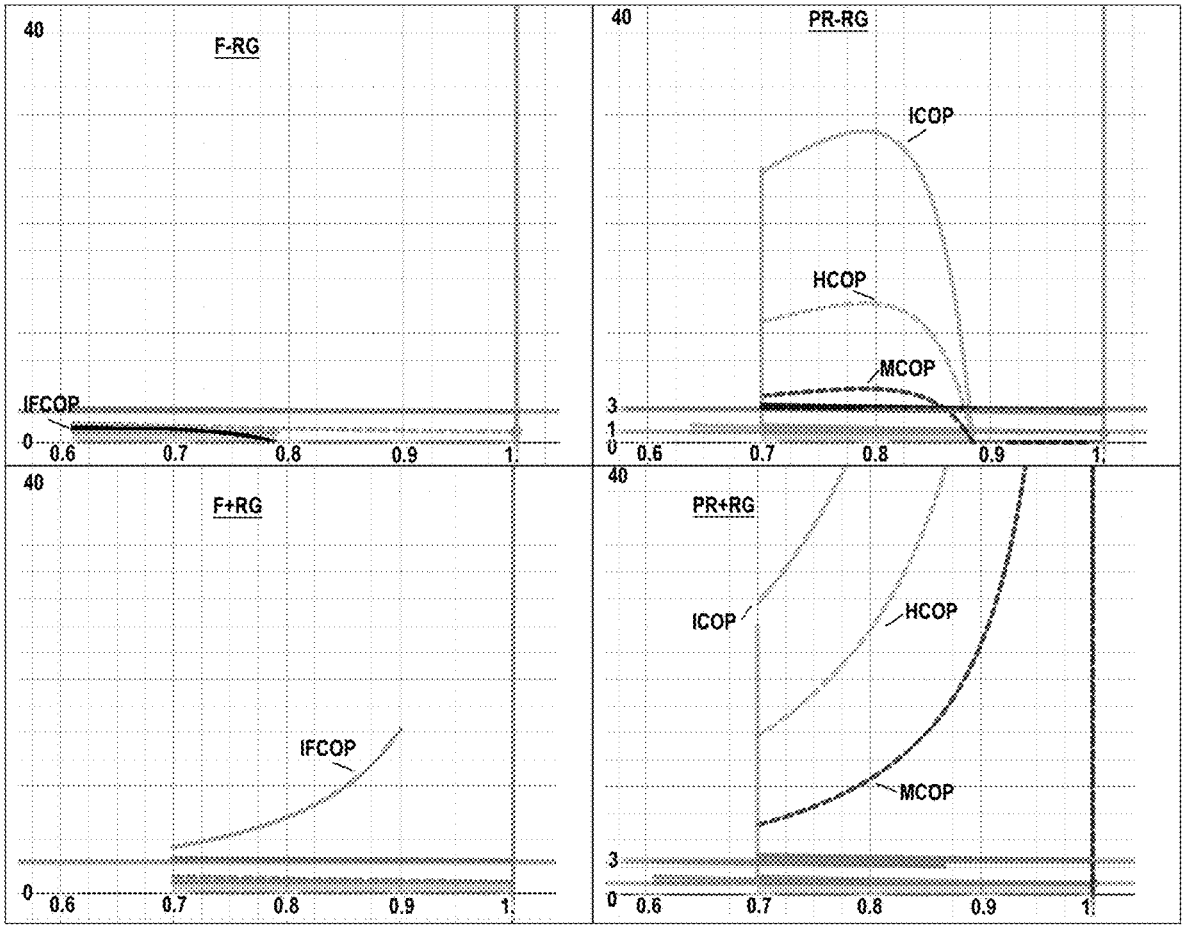
FIG. 5 shows the same graphs at 40 COP full scale.
Figure 6:
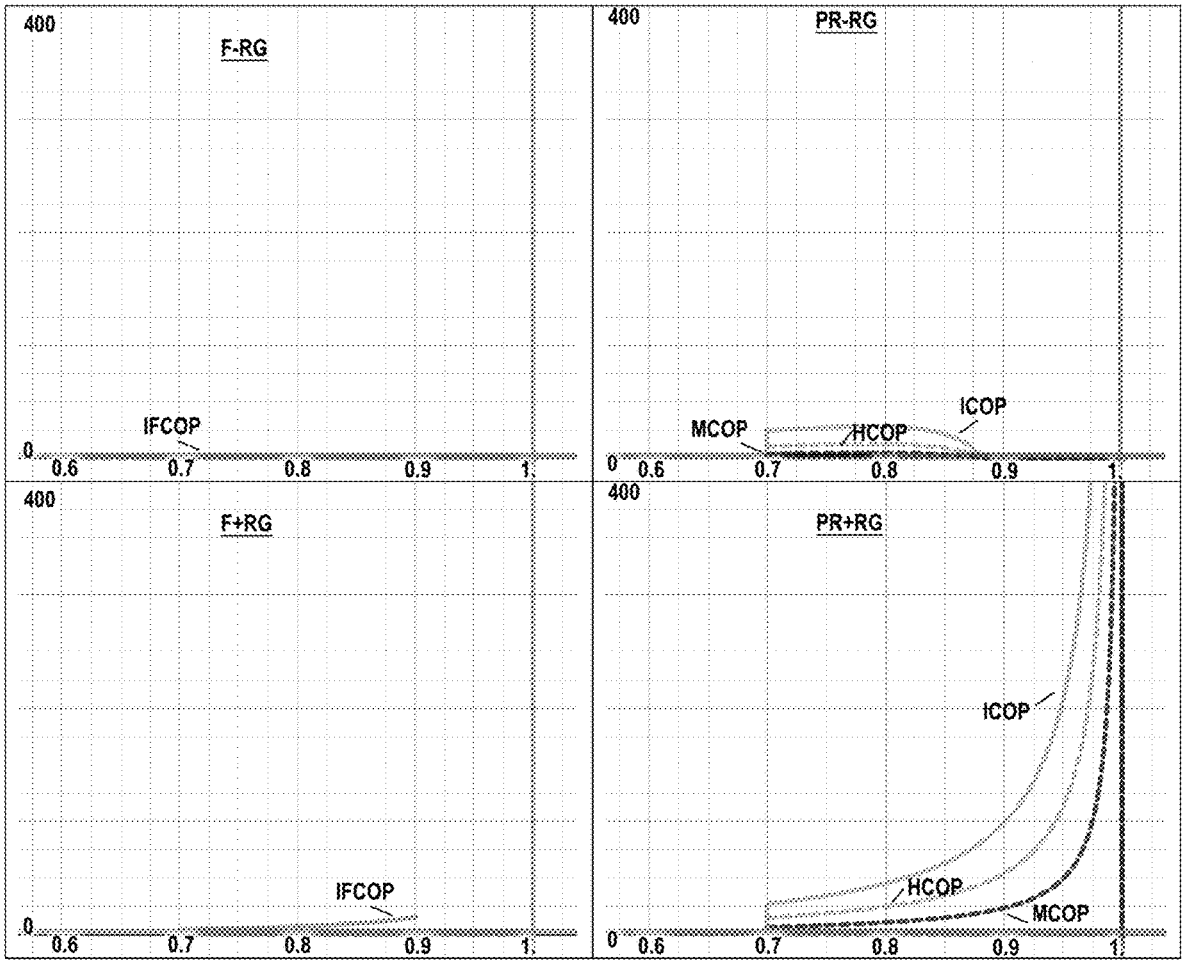
FIG. 6 shows the same graphs at 400 COP full scale, illustrating the unbounded potential efficiency of combining the two recycling methods.

In FIGS. 5 and 6, the Pressure and temperature curves are intentionally left on the graph to aid in understanding the magnitude of the changes in the COP curves. They are identical to those in FIGS. 1 thru 4, where they can be viewed with accuracy.

"Ideal" is used as is customary in evaluation of engine and heat pump efficiency, and where used indicates that only the thermodynamic effects are taken into the calculation, assuming perfect construction and perfect materials.

Temperature curves in FIG. 7 are relative to cool side ambient temperature, which is assigned value 1.

For pressure curves, scale is relative pressure to ambient pressure in cool side working fluid, which is assigned value 1. 2 is twice pressure of cool side.

H High temperature environment temperature, where heat is being pumped to.

L Low temperature environment temperature, where heat is being pumped from.

WH Heat added due to work of compression device.

WC Heat removed due to work of expansion device.

CW Compression work, the mechanical work added to the system to achieve compression.

EW Energy of expansion work, available for recycling so is subtracted from the value of CW.

E the heat energy pumped out of the lower temperature environment.

IFCOP Ideal Freon coefficient of performance (COP).

ICOP is ideal coefficient of performance of the Pressure Recycling air cycles.

HCOP is ICOP adjusted for 90% isentropic efficiency of compression/expansion devices.

MCOP is ICOP adjusted for 70% isentropic efficiency of compression/expansion devices.

P0, P1, P2, P3, P4, and P5 are phases of double acting piston based compression/expansion device.

GR is temperature range for gap recycling (In effect, it extends T2 and T4 curves).

T1 are compression curves, T2 are heat exchange cooling curves

T3 are expansion work temperature curves, T4 are heat exchanger heating curves.

T5 denotes approximately equal temperature drop from evaporation of refrigerant, varying because the temperature of the starting point varies. The recycling case begins evaporation at a lower temperature, so reaches a still lower temperature.

Solid t1-T5 curves are recycling case, dashed non-recycling.

AW is added work (which can be negative)

HW is heat moved due to volume change work.

HP is the approximately constant high pressure portion of working fluid.

LP is the approximately constant low pressure portion of working fluid.

TH is ambient temperature of higher temperature space. TH+, TH++ are temperatures elevated above TH.

TL is ambient temperature of lower temperature space. TL−, TL−− are temperatures dropped below TL.

VC is closed valve. VO is open valve, VC=>VO is transition to open, VO=>VC is transition to closed.

GCFHE is a gap energy recycling counter flow heat exchanger.

TU represents turbine, CW represents compression wheel.

CO represents coupling via mechanical, electrical or other mechanism to transfer energy.

RE is rotary expansion device. RC is rotary compression device.

ED is generic expansion device, CD generic compression device.

FEV is Freon or other refrigerant expansion device.

F−GR is Freon/refrigerant system NOT using gap energy recycling device.

F+GR is Freon/refrigerant system using gap energy recycling device.

PR−GR is vapor system using pressure difference energy recycling but NOT using gap energy recycling device.

PR+GR is vapor system using pressure difference energy recycling and gap energy recycling device.

CFM is cubic feet per minute bar is atmospheric pressure scale.

ton is 1 air conditioning measurement ton scale, rate of heat movement.

kw is kilowatt, also a rate of heat movement.

Unit denotes the collection of compression and expansion devices CD and ED, and GCFHE.

RETRO denotes location for retrofit of gap energy recycling device.

PF denotes permafrost

HSP denotes heated space

FIG. 1 thru 4 show the effect on COP of the 2 recycling methods singly and together on 2 phase refrigerant systems and 1 phase vapor systems. COP is dramatically better when combining both methods.

FIGS. 5 and 6 are the same graphs as FIG. 1 thru 4, but with full scale of 40 COP and of 400 COP. FIG. 6 in particular shows a dramatic increase in COP when using both recycling methods as opposed to using either alone or no recycling.

FIG. 7 shows temperature curves for 1 phase systems (top) and refrigerant systems (bottom). Only the gas compressed phase portion of the refrigerant systems are shown, since all effects on efficiency come from there. The solid lines are with gap energy recycling and the dashed are without. All temperatures are relative to the cooled space as a starting point, and cycles given equal compression energy. Note the solid lines extend much farther below the cooled space baseline temperature, indicating that more heat can be stored in the cooled fluid for the same amount of expended compression energy. The same gap, 5%, is used as in above graphs. Corresponds to room temperature (75 F, 27 C, or 300 F) up to a hot outside temperature (100 F, 42 C, 315 K). Recycling benefits any systems at any gap, and benefits are increasing for increasing gap.

FIG. 8 is a Pressure and Temperature Vs Volume for air. Heat (or Temperature) vs. Volume is expressed with $$\text{Heat}=k*\text{Volume}^{-.beta} \text{ and Pressure vs. Volume as } \text{Pressure}=k*\text{Volume}^{-(1+beta)}.$$

For air beta is 0.4, a property of the mixture of gases making up air. So for air:

$$\text{Heat}=k*\text{Volume}^{-0.4} \text{ and Pressure}=\text{Volume}^{-(1+0.4)}.$$

FIG. 9 Shows work area being stored as heat in air=total of dark and light great areas, HW+AW. HW is Pressure*Volume Work, AW=Added Work (by a compressing device). The Coefficient Of Performance is the ratio of the total area to the light gray area, if no recycling occurs.

FIG. 10 Shows Work area for Heat being removed from Air is Dark Gray (HW or work due to Pressure*Volume). For Added Work (by force applied to device) in light gray (AW). Coefficient Of Performance is ratio of dark gray area to light gray area (non-recycling case). The Pressure Recycling method produces a cooling effect shown by the "relative heat curve". The work in this case, taking vertical axis 1 as the high pressure side, may be done by the air on the device, where the relative pressure curve represents the low pressure area or cool side of working fluid. The AW work becomes negative, and added to the AW of the compression side, results with a radically reduced net added work necessary. In an ideal system which was not dissipating heat, once the pressure difference was established the air would circulate through both low and high pressure sides of the loop without adding energy. Of course real construction does not allow this level of efficiency. The actual net work is a combination of the imperfections of the device and materials, and the thermodynamic work done in each transition of air to high or low pressure. The work is then average pressure times volume change, and the net becomes the difference in the initial and final volumes times average pressure. The difference in volumes, since the system operates with two areas of constant pressure, is determined by the initial absolute temperature before traversing to the opposite pressure region, by using the ideal gas law.

Figure 11:
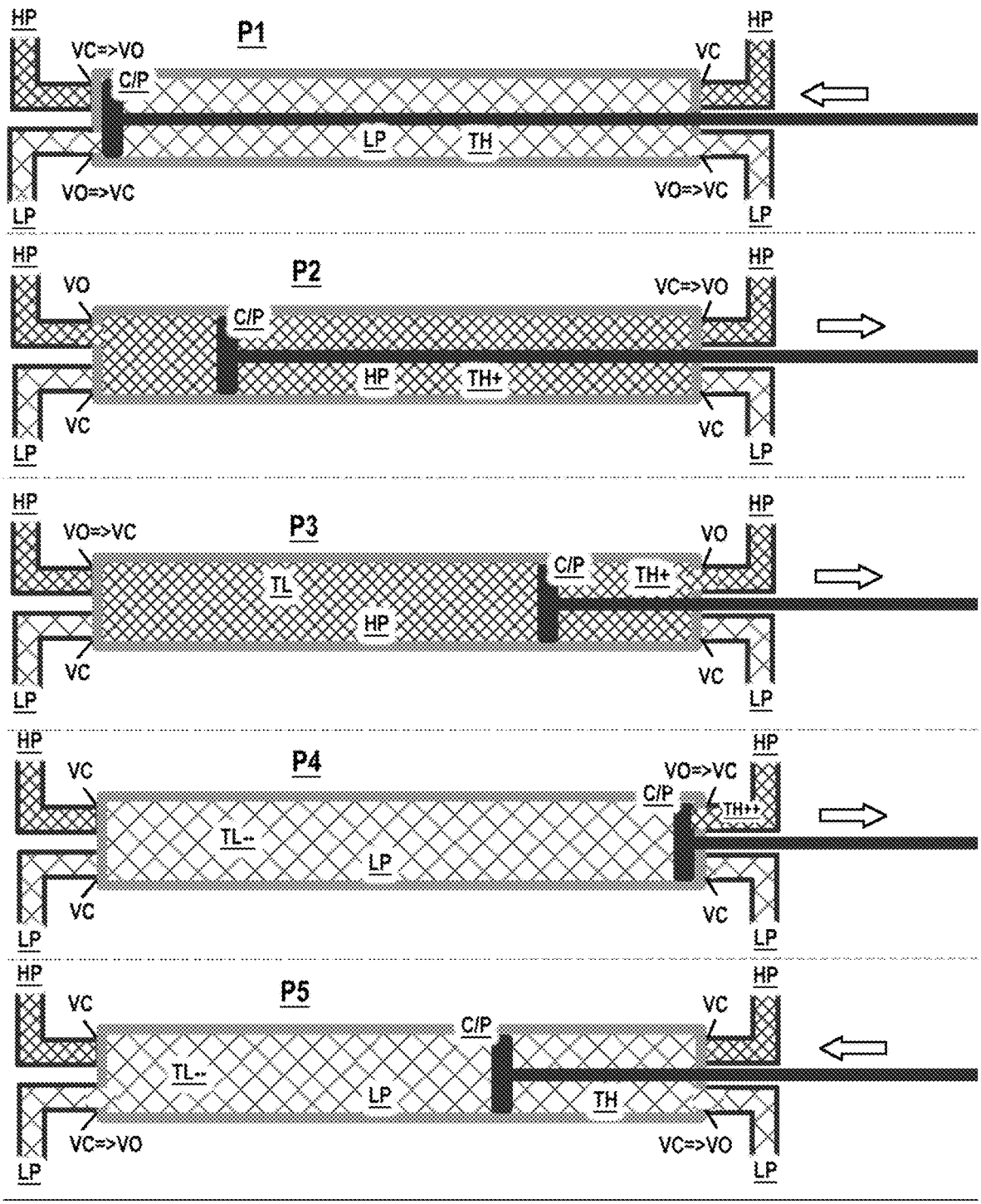
FIG. 11 discloses a cylinder/double acting piston as combined compression/expansion device.

FIG. 11 shows use of double acting piston to provide part of compression mechanical energy from high pressure side, and then provide more assist by using heat energy in a unit mass's volume at high pressure.

P1 illustrates starting point of sequence, piston completely filled with low pressure vapor at TH temperature.

P2 shows low pressure valves close, and intake high pressure valve opens until pressure equalizes, which also heats vapor from P1 above TH. Intake vapor is at TL. Once pressure equalizes, exhaust HP valve is opened. Note intake from high pressure is at TL, and intake from Low pressure is at TH, due to heat exchange from gap energy recycling. P2 to P3 transition operates with both HP valves open (not shown), which because pressure is equalized requires negligible work in ideal system.

P3 shows only step external force is required to assist complete compression. It operates with high pressure intake valve closed, and exhaust valve open. External force on piston rod expands against approximately constant HP, expanding unit mass on intake side of piston, which also cools it below TL.

P4 shows end of P3 operation. Vapor taken in from high pressure loop is now cooled below TL. High pressure valve closes, allowing low pressure part of cycle to begin again. P5 exhausts cooled vapor already at LP and TL--, and intakes vapor at LP and TH, and continues until state in step P1 is reached. Note pressure is equalized, so in ideal system work energy is negligible.

Figure 12:
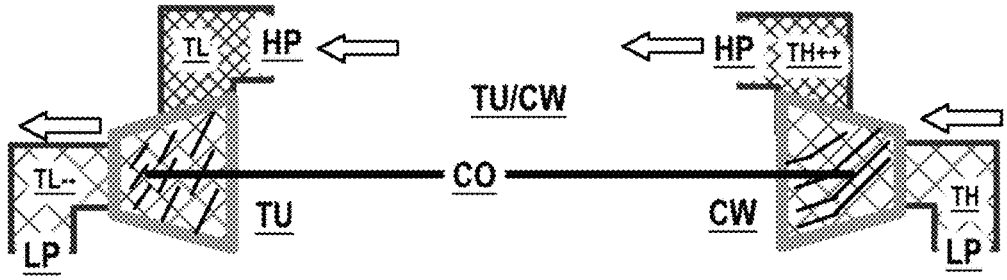
FIG. 12 discloses use of turbine/compressor wheel as combined compression/expansion device.

FIG. 12 shows use of turbine/compression wheel pair to recover expansion energy and provide compression which must be assisted with external force. This is similar to proven technology of turbo-charger, moving energy from exhaust back to intake. Various forms of frictionless bearing exist, air and magnetic bearings, as well as brushless motors. This system offers greatest mechanical simplicity, as it has only one moving part and potentially no wear surfaces. However, the speeds the part must turn at are typically in 10,000 revolutions per minute (RPM) to 100,000 RPM, higher speed than typical motors. This is the most easily controlled system, as it simply requires varying speed to match required heat moved per unit time.

Figure 13:
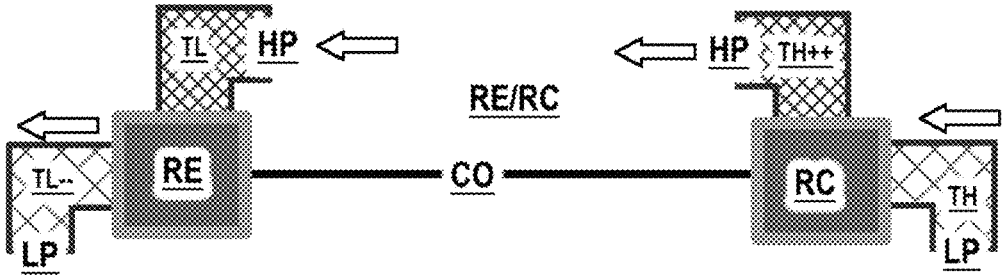
FIG. 13 discloses use of any rotary compressor coupled with a similar rotary pneumatic motor as combined compression/expansion device.

FIG. 13 shows use of any rotary compressor with any pneumatic powered motor, coupled mechanically or electrically, may be use to provide energy transfer from expansion to compression. There are multiple types of existing devices that can be adapted to this use. Primary advantage would be not requiring extremely high speed motors. Of course, some external force must be added to make this system operate, true for all 3 cases.

Figure 14:
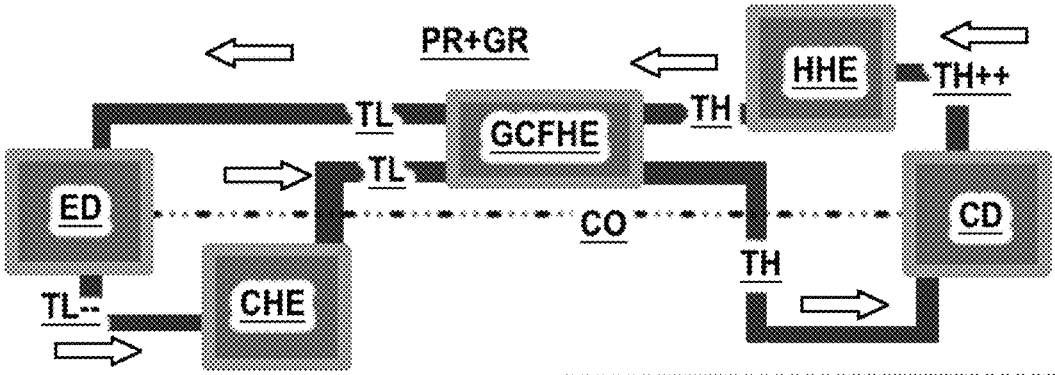
FIG. 14 Discloses the loop block diagram for fluid flow through the air/vapor based system using pressure difference energy recycling combined with gap energy recycling.
Figure 15:
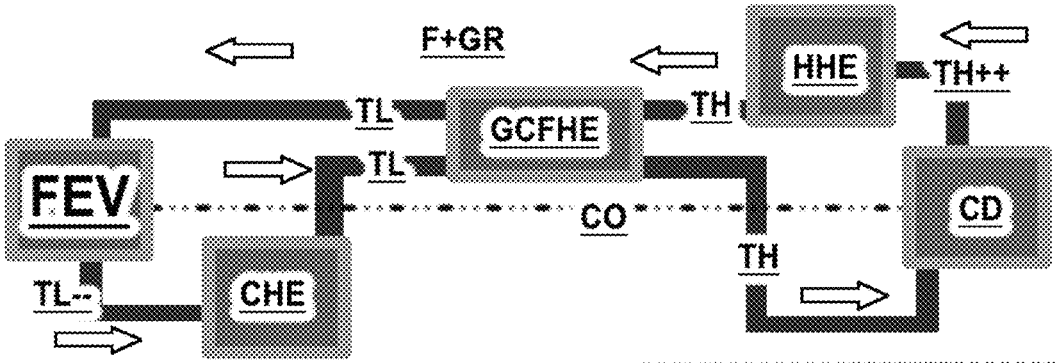
FIG. 15 Discloses the loop block diagram for fluid flow through the Freon liquid/vapor based system using gap energy recycling, which differs from previous FIG. 14 only in the block responsible for creating temperature drop.

FIGS. 14 and 15 are extremely similar, flow block diagrams of working fluid for Freon (or other refrigerant) liquid/vapor based (15) and vapor based (14) systems. The configuration is the same, and its even possible to retrofit existing heat exchangers to use new working fluid, compression and expansion devices. They only differ in the block ED for vapor systems and FEV for refrigerant fluid systems.

Figure 16:
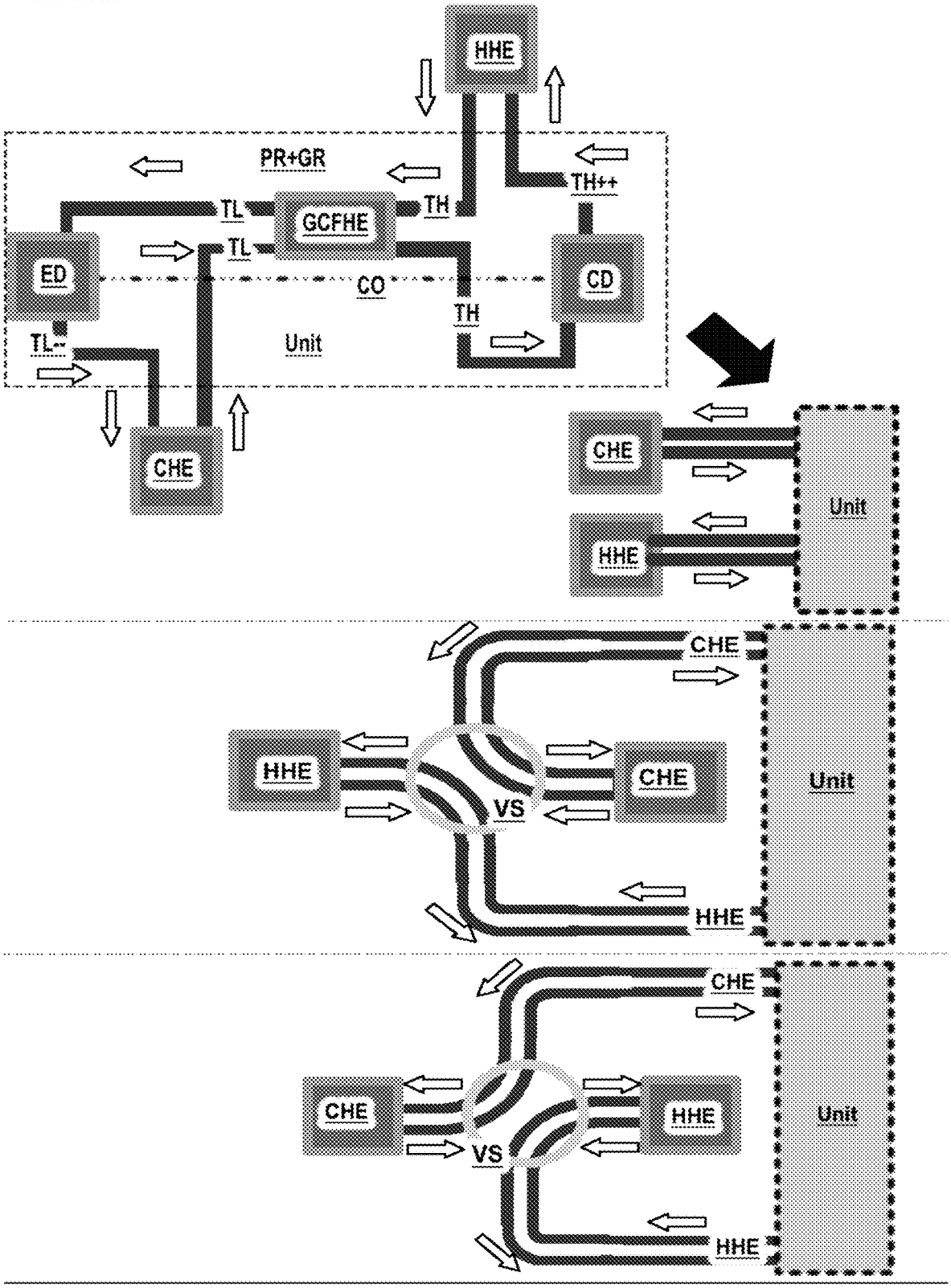
FIG. 16 shows block diagrams for converting a one direction cooling or heating system into a switchable direction system, as it differs from existing switchable direction refrigerant systems.

FIG. 16 first identifies a block comprised of expansion device, compression device and gap energy recycling device, labeled "Unit". Then shows 3 block diagrams, illustrating deployment options: a fixed configuration applicable to refrigeration, freezer and air conditioning systems and a switchable configuration which can via valve switch (VS) treat either of the systems space heat exchangers as hot or cold heat exchangers to effect switching direction of heat flow.

Figure 17:
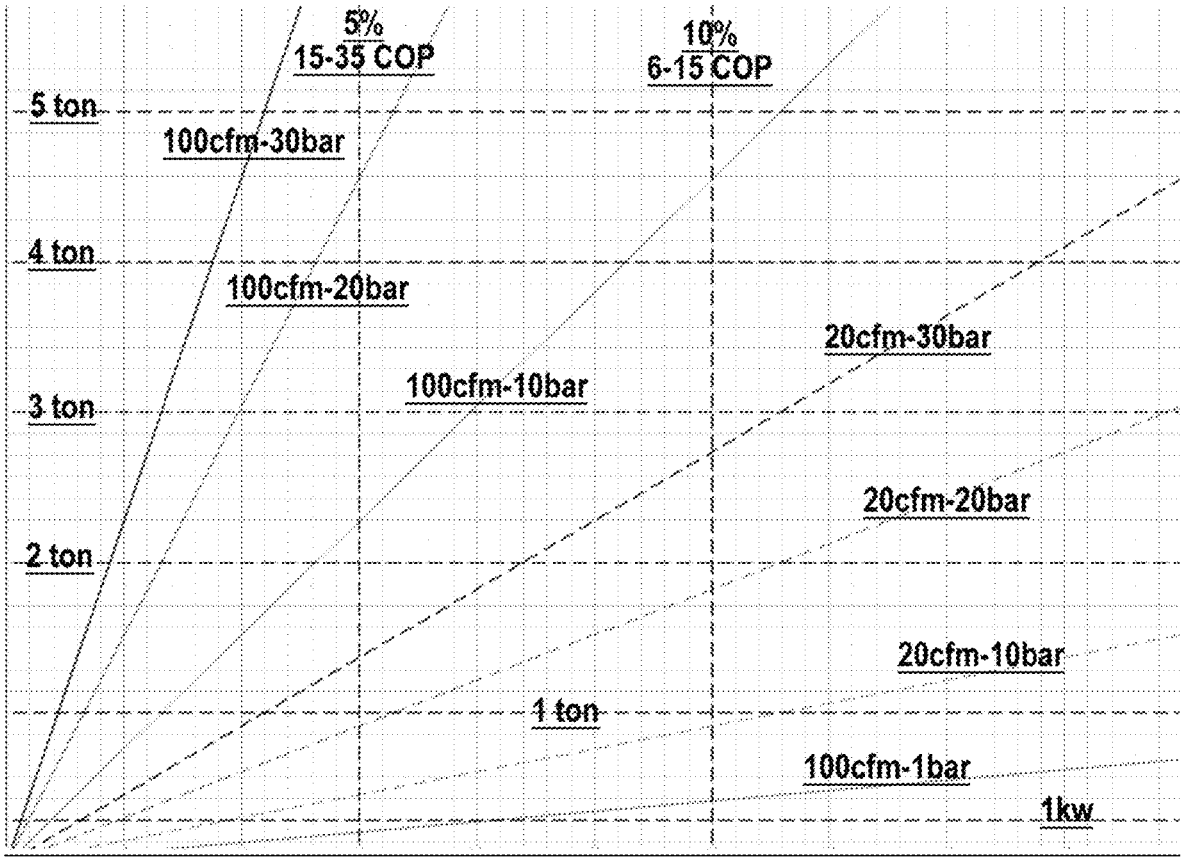
FIG. 17 shows for working fluid of nitrogen or air for a gas phase system, how to achieve varying heat moving capacity, which is the product of the rate of mass flow of working vapor and its specific heat and the temperature drop at the environmental heat exchangers.

FIG. 17 shows calculation of energy conveyed by gas phase system using air. It is approximately equal to a Freon refrigerant system operating at the same pressure. It can be tuned for equipment and performance requirements by varying pressure, rate of flow, and size of temperature range in environmental heat exchange devices. Temperature drop is determined by relative pressure difference. Increasing pressure difference increases rate of flow and temperature range.

Figure 18:
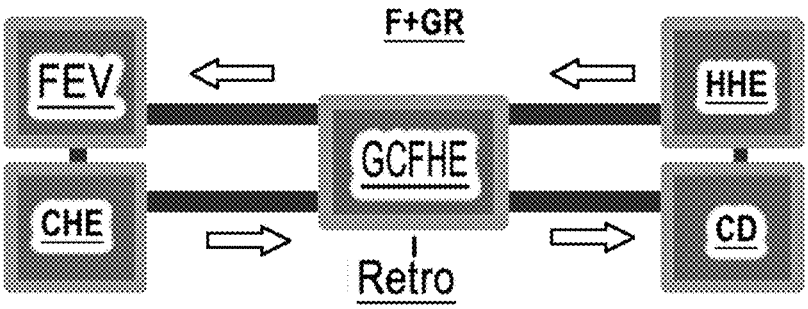
FIG. 18 shows location to place GCFHE to retrofit existing refrigerant based systems for gap energy recycling.

FIG. 18 shows placement of GCFHE device to retrofit existing one directional air conditioning, refrigeration or other refrigerant based heat pump systems.

Figure 19:
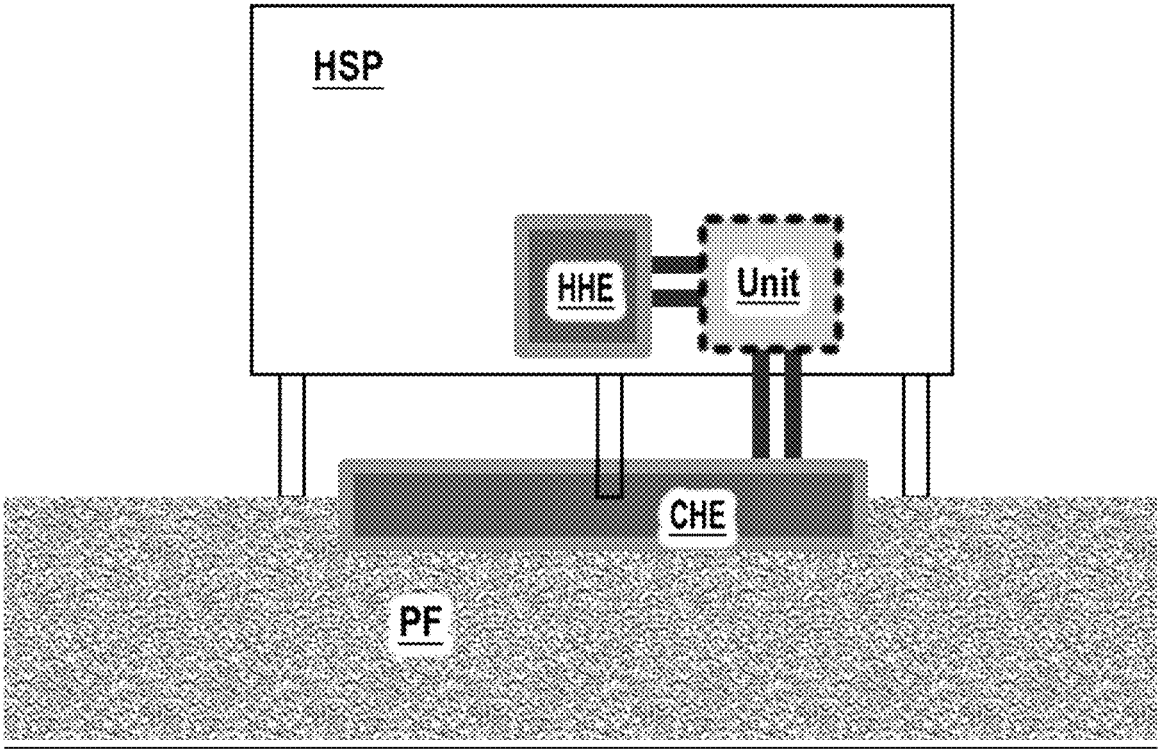
FIG. 19 shows layout of 1 phase system with both recycling methods applied to the problem of creating heated space over permafrost without causing damage to permafrost.

FIG. 19 shows application of the highest efficiency (COP) systems to arctic conditions, allowing heating while protecting permafrost from melting due to building heat.

DETAILED DESCRIPTION OF THE INVENTION

The system is designed recognizing three facts about the thermodynamics of pumping heat.

First, the maximum efficiency (COP) will be achieved by operating at a minimum pressure difference.

Second, the work done in compression can be mirrored by a similar expansion device (piston, air motor or turbine), and in the ideal case would result in reducing work energy added to the system by (1−ratio of absolute temperatures). The work energy produced by the expansion device then remains in the system, and once operating does not need to be replaced. This allows an amount of energy equal to the work available from expansion to be recycled, and remains in the system via the coupling of the expansion and compression stages.

Third, in both Freon and air based systems, the working fluid leaving the cool space is at cool space's ambient temperature, and leaving the hot space is at the hot space's ambient temperature. This creates a temperature gap the working fluid must cross before beginning to begin usefully exchanging heat on either side. The fluid must be brought from the cool ambient, then to the hot ambient, then beyond to expel heat into the hot space. This takes work that increases as the gap increases, and ultimately means there is a temperature difference at which the heat pump cannot function. Recognizing that the temperatures leaving the hot space space is the ideal for entering the compression stage and the temperature leaving the cool space is ideal to enter the temperature reduction stage, it is clear that exchanging the temperatures between the fluids as they cross the gap, which is as they each leave a heat exchanger and before they enter the temperature shift device, will produce ideal performance. This is gap energy recycling. It moves heat from the Hot space, and places it where it has a benefit, just before circulating vapor the compression stage where the vapor reenters the higher pressure portion of the system on its way to the hot space's heat exchanger.

By using the two recycling methods, it is always possible to do move some heat from a cold area to a hot area, with a minimal pressure difference. There will be a practical minimum due to the imperfection of the construction.

For the systems using recycling, the negative effect of increasing temperature difference on COP is a second order one, as it enters the computation as the ratio of the absolute hot and cold temperatures.

Moving more heat per unit time requires increasing the pressure difference.

The work needed to operate the system is given as follows. Let AW be work added to do compression of the cooler low pressure fluid to increase its pressure and temperature. Let E be the heat energy moved. Let R be the ratio of the absolute temperatures. Let SW be the work done by the high pressure air in the expansion device, arranged to assist the compression device. The net work (NW) is then (AW-SW) which is also equal to AW*(1−R). The temperature gap only affects the outcome in the term R.

Shown on the graphs is about a 30% compression, creating (for air) about a 10% to 15% absolute heat rise. The system can be adjusted to use a smaller compression, for a smaller heat rise, and lower rate of heat flow but proportionally larger heat movement relative to expended energy. Although R, the absolute temperature ratio is fixed by the environment and limits the energy recycling, the efficiency can still be driven arbitrarily high by reducing the rate of pumping which is done by reducing the pressure difference.

Pumping heat at a lower rate requires better insulation between the cool and hot spaces. This allows not just less heat energy to be moved, but allows the energy required to move the heat to be reduced exponentially.

Although most of the discussion is based on air based systems, any working vapor may be used. For example, if producing a device to cool liquid Nitrogen, Neon can be used as a working fluid, as it has a much lower boiling point than Nitrogen. Other than the gamma constant for Neon must be used, the calculations and behavior all remain the same. As another example, helium may be used for applications from 1 K to 200 K including MRI, telescopes and other equipment requiring extremely low background noise afforded by very low temperatures.

Using a gap energy recycler requires the position between space heat exchanger and temperature shift device. So it can be easily retrofitted into air conditioners and refrigeration systems. It cannot be easily retrofitted into existing Freon based heat pumps, as they have only one compressor, and the typical arrangement is that the compressor is outside, heated space heat exchanger is inside, preventing replacing the refrigerant lines with GCFE equivalent. For systems which pump heat in one direction, retrofit with GCFHE consists of replacing a pair of lines, liquid and gas, with a counter flow heat exchanger consisting of the equivalent lines, and overall insulation.

Pressure difference energy recycling is accomplished by placing a similar device to the compressor operating in reverse. For a piston based compressor use an additional paired piston or double acting piston acting as expansion device. For a compressor wheel compression device, pair it with a turbine expansion device, exactly as is done in turbochargers, to move energy from the expansion between high and low pressure vapor paths, to assist compressing vapor from the low pressure path up to the high pressure path. For a rotary compressor, an rotary air motor can provide the expansion, taking care to match the isentropic efficiency of the two part to achieve similar temperature change. See FIGS. 11, 12 and 13.

Single phase pressure energy recycling systems are most efficient, so have lower operating carbon footprint. Also, they would normally be filled with non-polluting air, as opposed to any type of refrigerant, all of which are pollutants if leaked from system. Freon 410, according to manufacturers (Dupont) technical sheets have a carbon footprint of 1 ton per pound of refrigerant. There is also a significant decrease in carbon footprint for construction and maintenance of an air based system, relative to any type of refrigerant based system.

Single phase systems using air may be used in arctic regions for efficient heating from outside heat energy. Additionally, in buildings over permafrost, constructed with stilts to avoid melting the permafrost, the system can place its heat exchanger under the structure, insuring the surface of the permafrost remains frozen regardless of building heat. There is abundant available atmospheric heat even at the lowest recorded temperature on Earth of 184 K, which is 100 K above the liquefaction point of Nitrogen and has 100*250/300*3/2 or about 120 joules of free heat energy in gas phase per liter of atmosphere, more than enough to continuously add up to 100 joules of energy per second to any occupied air space.

The single phase system has a wide variety of implementation methods, including turbine/compressor wheel combinations. Existing industrial compressor wheel equipment is available with no wear surface, using air bearings. The drive mechanism can be integrated into the turbine/compressor wheel structure forming a single moving part. Existing motors are available up to 1 million RPM, more than covering the range needed for operation. If the motor is brushless, it could also be made with no wear surface, so the portion of the device labeled UNIT in Figures, could be made with a single moving part with no wear surfaces. In turn, this methodology yields long service lifetime and high reliability.

The various embodiments are directed to a class of heat pumps, air conditioner, refrigeration, freezing or heating devices which move heat from a cooled space or object to a heated space or object and which recycle a portion of the compression energy expended and/or recycle the majority of the heat difference between the cooled space and heated space, comprised of either a 2 phase refrigerant based system or a 1 phase vapor based system and implemented by one of several disclosed compression/expansion mechanisms and each systems consisting of either a closed loop of working fluid or an open loop of working fluid and may be used to accomplish cooling environmental air and/or heating environmental air, cooling refrigerated spaces, cooling freezer spaces, making ice, melting ice, causing, inhibiting or controlling chemical reactions by cooling or heating, solidifying liquids by cooling, melting solids by heating, moving heat for cryogenic devices, heating water, cooling water, liquefying gases by cooling or vaporizing liquids by heating or any other purpose heat pumps may be applied to; either of which recycling method increases the ratio of heat movement to energy added to the system otherwise known as Coefficient of Performance or (COP).

Devices of the various embodiments may have a closed loop or open loop consisting of a low pressure side including one or more environmental heat exchangers to cool the desired space, fluids or objects and a high pressure side including one or more environmental heat exchangers to heat the desired space, fluids or objects, where closed systems have both high and low pressure sides and open systems have one of a closed high pressure side coupled with an open low pressure side or a closed low pressure side coupled with an open high pressure side and may additionally have one or more counterflow heat exchangers connected to pass heat between high and low pressure sides, connected to pass heat between closed high pressure side with environmental air or fluid, or connected to pass heat between closed low pressure sides and environmental air or vapor.

Devices are disclosed with 3 variations of compression mechanisms all capable of an inverse expansion mechanism that delivers back a portion of power expended in compression which can be coupled mechanically, electrically or b other means to assist in providing compression power, mechanism A is a double acting piston (FIG. 11) or paired pistons and alternates between accepting higher pressure working fluid from either the high pressure side or environmental vapor such as air then expanding it to both cool it and lower its pressure and expelling the expanded cooled working fluid into either the low pressure side or environmental vapor such as air and accepting lower pressure working fluid from either the low pressure side or environmental vapor such as air then compressing it with assistance of power of the expansion of the higher pressure working fluid to both heat and increase its pressure, and expelling the compressed heated working fluid into either the high pressure side or environmental vapor such as air; mechanism B (FIG. 12) is a turbine expansion device and a compressor wheel compression device coupled mechanically, electrically, hydraulically or by other means to move power from the expansion of working vapor in the turbine to assist driving the compressor wheel; and mechanism C (FIG. 13) is a rotary pneumatic motor or motor/generator and a rotary compressor device coupled mechanically, electrically, hydraulically or by other means to move power from the expansion of working vapor in the pneumatic motor or motor/generator to assist driving the rotary compressor.

Devices may recycle heat energy between the heated space and cooled space (FIG. 14 and FIG. 15) which is the energy necessary to heat the working fluid from the cooled space or object to the same temperature as the heated space or object, consisting of a counter flow heat exchanger placed between the intake of the compression mechanism and the intake of the expansion mechanism which will transfer heat from hotter working fluid exiting the heated space or object into the cooler working fluid exiting the cooled space or object, resulting in the working fluid entering the compression device is preheated to approximately the same temperature as the heated space or object and the working fluid entering the expansion device being pre-cooled to approximately the same temperature as the cooled space or object thereby avoiding expending compression energy to raise the working fluid temperature from the cooled space or object temperature up to the temperature of the heated space or object and instead all the compression energy expended results in pumping some heat from the cooled space or object into the heated space or object, and avoiding the problem whereby some or all the temperature drop achieved by the expansion device does not reach the maximum difference below the temperature of the cooled space or object as shown in graph on FIG. 7 both 1 phase vapor systems and 2 phase refrigerant systems benefit significantly.

Devices may have an expanded operating temperature range as compared to existing systems not using either form of heat recycling where the 1 phase vapor systems are limited only by the range of temperature in which the operating fluid is in vapor phase, and 2 phase systems are limited only by the temperature range over which they can achieve the necessary phase change, and both systems can operate with little or no energy expenditure required to preheat working fluid from the cooled space and pre-cool working fluid from the heated space to a useful temperature to immediately begin heat energy transfer when expansion or compression begins as opposed to a portion of expansion being wasted cooling the working fluid to that of the cooled space temperature or a portion of compression bein wasted heating the working fluid up to the heated space temperature, yielding sizable and immediate performance gains as measured by COP which is shown in graphs of FIG. 1, FIG. 2, FIG. 3, FIG. 4, FIG. 5 and FIG. 6 and with the highest performance configuration would be able to operate as a heat pump from the coldest recorded temperatures on Earth up to room temperature with a COP significantly greater than 10 for ideal systems and greater than 2 for real world systems because as shown in FIG. 8 and FIG. 9 the COP of any system tends toward infinity as rate of heat movement drops; however Refrigerant based systems, which have a higher lower bound of operating pressure difference due to the requirement to force phase change, do not have as wide a range of operating temperatures as the 1 phase vapor systems, but still do increase their COP at smaller rates of heat movement and operate over wider range of temperatures than do refrigerant based systems which do not use any energy recycling.

Figure 1:
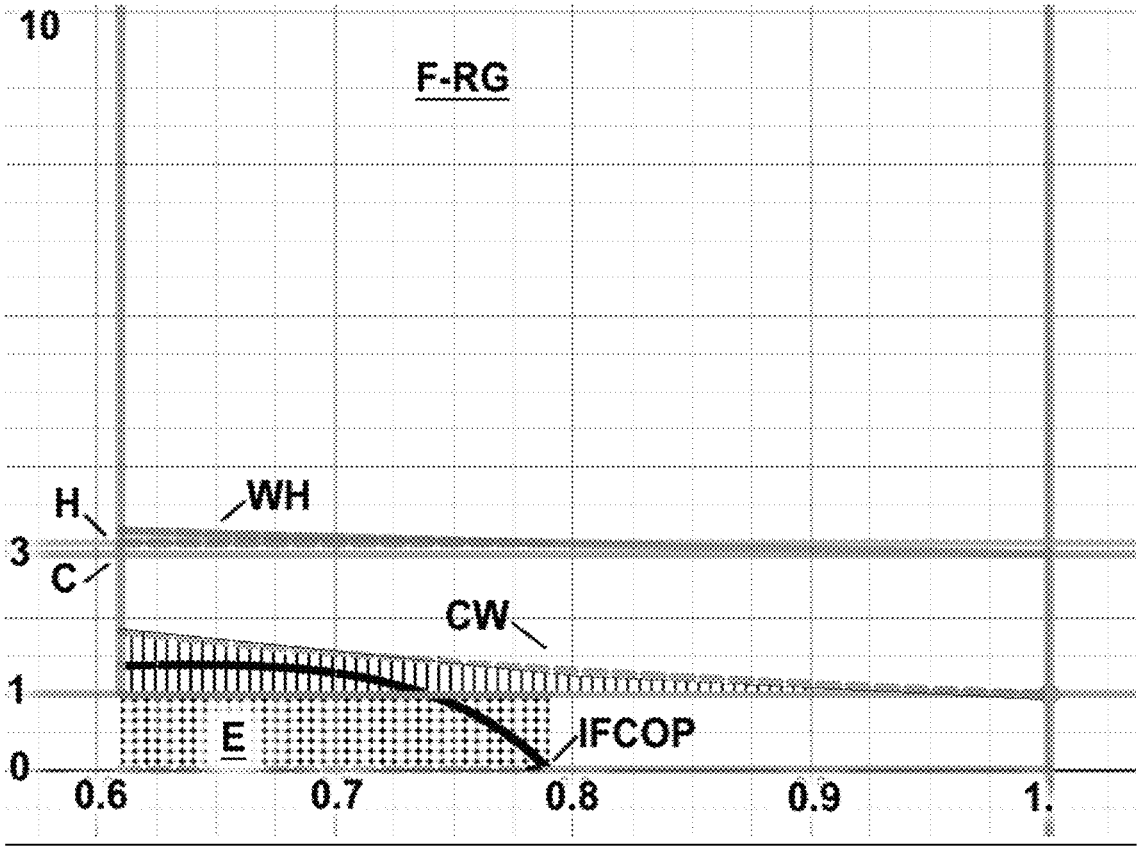
FIG. 1 labeled F−RG is a Freon system without recycling, ideal COP plotted.
Figure 2:
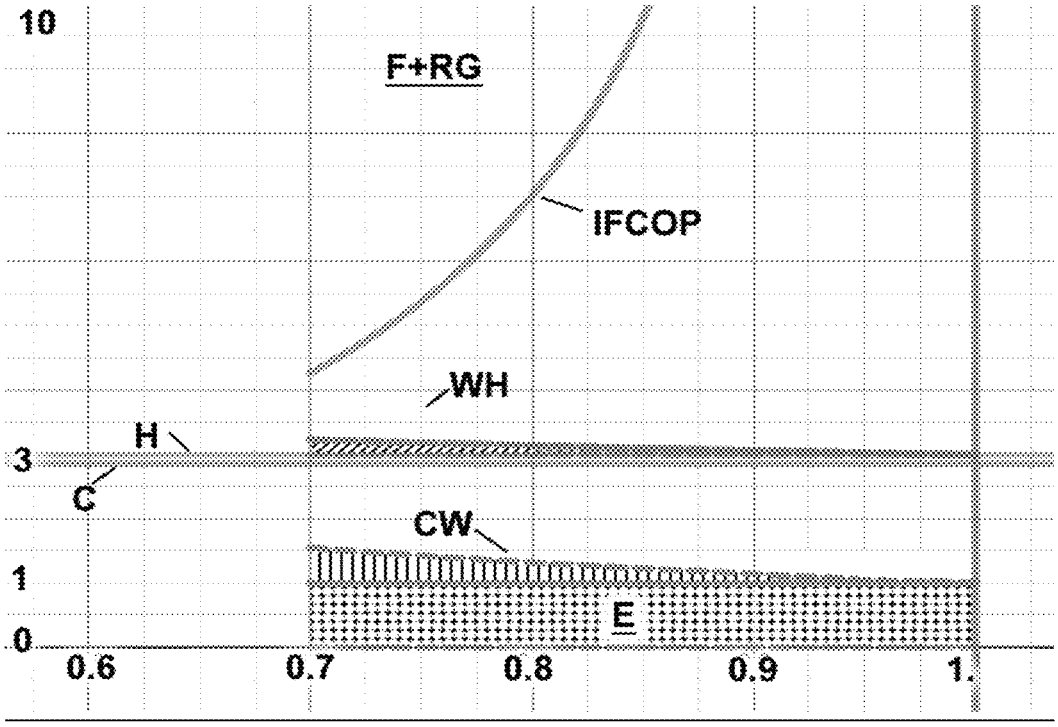
FIG. 2 labeled F+RG is Freon system with gap energy recycling, ideal COP plotted.
Figure 3:
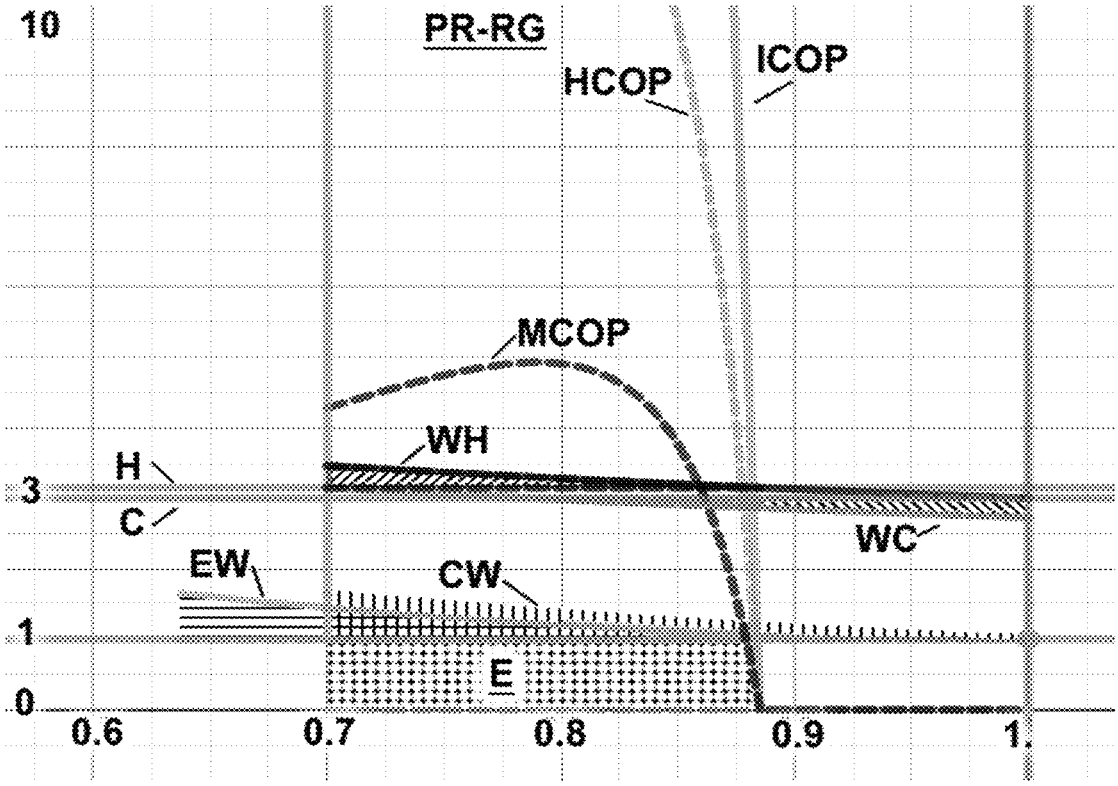
FIG. 3 labeled PR−RG is air system with pressure difference energy recycling and without gap energy recycling FIG. 4 labeled PR+RG is air system with both pressure difference recycling and gap energy recycling.
Figure 4:
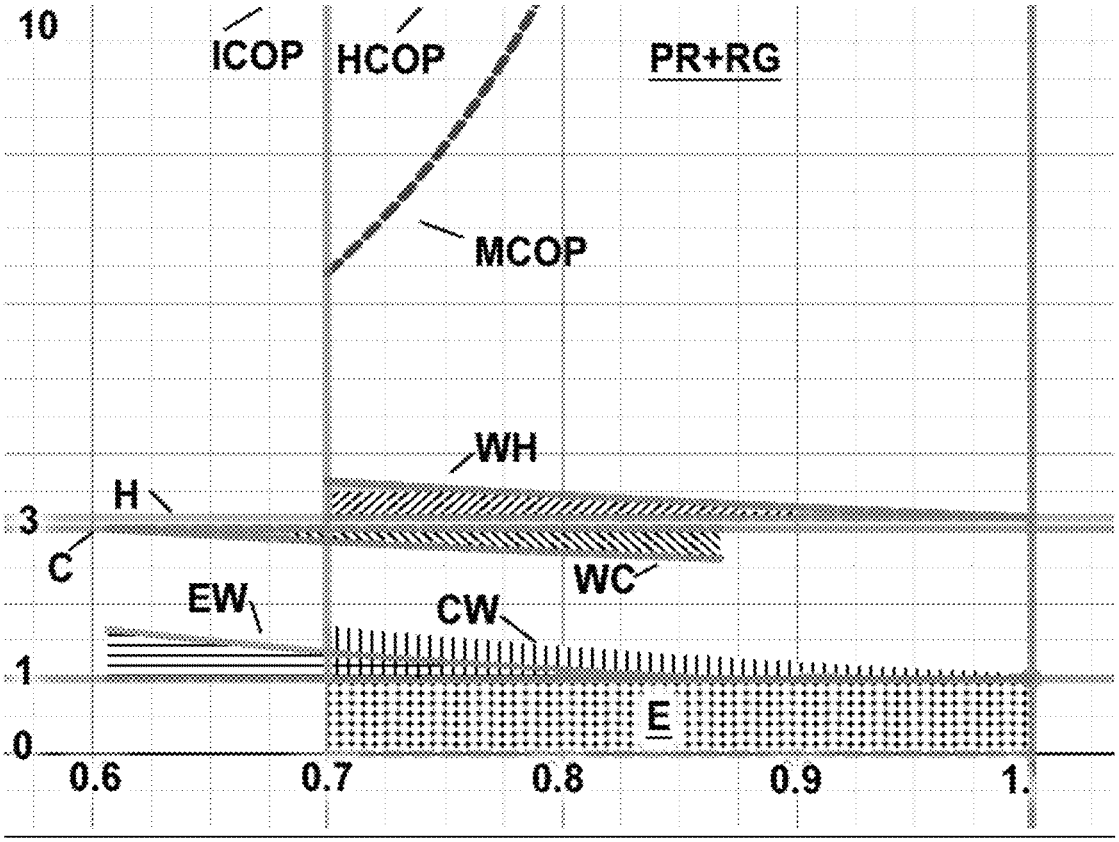

Devices may use both recycling methods have a theoretically unbounded COP as the rate of heat energy transfer falls to 0, which is shown in graphs of FIG. 1, FIG. 2, FIG. 3, FIG, 4, FIG. 5 and FIG. 6, and for systems in general on graphs in FIG. 8 and FIG. 9, although real systems will have imperfections in construction and materials which will determine an actual cap on COP range and graphs labeled PR+RG and PR−RG also have 2 curves showing the effect of isentropic energy efficiency below 100%, first the calculated COP for high efficiency turbine/compressor wheel combinations achieving 90% isentropic efficiency (HCOP) and second the calculated COP for medium efficiency turbine/compressor wheel combinations achieving 70% isentropic efficiency (MCOP) and FIG. 6 shows all calculated COP including the simulated real world curves HCOP and MCOP have an unbounded upward trend as rate of energy transfer drops toward zero, two orders of magnitude above the calculated COP of non-energy recycling systems.

Devices have overall system configurations are shown in FIGS. 14 and 15 showing near identical configuration between 2 phase refrigerant systems and 1 phase vapor systems allowing retrofit of energy recycling into existing systems using environmental heat exchangers (HHE and CHE) already in use (FIG. 18), but systems which are required to reverse direction of heat flow have significantl different configuration as compared to Freon heat pump systems which have a single compressor at their outside unit (often called the condenser unit), with the difference shown in FIG. 16, which shows switching direction consists of switching flow between the heated space heat exchanger HHE and the cooled space heat exchanger CHE and although not shown altering the system to be an open loop consists of simple removing either CHE or HHE, but not both, and the working fluid is then the environmental fluid the system is enclosed in such as air.

Devices are capable of pumping heat from lower outside temperatures to heat buildings and vehicles than devices which do not do energy recycling and the 1 phase air system using both recycling methods is capable of heating spaces from arctic temperatures and configuring according to FIG. 19 can be used to simultaneously heat an occupied space to comfortable temperature of 300 K and cool a layer of permafrost because there is abundant available atmospheric heat even at the lowest recorded temperature on Earth of 184 K, which is 100 K above the liquefaction point of Nitrogen and has 100*250/300*3/2 or about 120 joules of free heat energy in gas phase per liter of atmosphere, more than enough to continuously add up to 100 joules of energy per second per liter to any occupied air space since interior space is always many times smaller than outside atmosphere volume.

Devices have lower carbon footprint relative to heat pump than devices which do not do energy recycling due to increased efficiency (COP) and the 1 phase devices using both disclosed energy recycling methods cannot cause pollution from leaked refrigerant since they can use air, and have lower carbon footprint than heat pump devices using refrigerant as all refrigerants require a sizable carbon footprint to manufacture as an example Freon 410 has a 2000 pound CO2 footprint per 1 pound of refrigerant according to its manufacturer so since the 1 phase devices using both disclosed energy recycling methods and operating with air as working fluid have zero fluid manufacturing CO2 footprint and therefore have lower CO2 footprints for each of installation, maintenance and operating energy.

Devices using the energy recycling methods have application for cryogenic heat pump given working vapor suitable for required temperature range, such as neon for applications from 30 K to 200 K including liquefying air or air components nitrogen and oxygen and cooling liquid nitrogen and oxygen; helium for applications from 1 K to 200 K including MRI, telescopes and other equipment requiring extremely low background noise afforded by very low temperatures: and any other vapor suited to its environment such as inert gases for controlled environments, gases intended to cause or alter chemical reactions during manufacturing or for other required temperature range.

Devices using both disclosed energy recycling methods and are 1 phase systems may have is few as 1 moving parts to construct the Unit portion of the system from FIG. 16 comprised of a turbine, motor and compressor wheel combined rotating part and may further be manufactured as a high reliability and long life part by using existing techniques to construct the part without wear surfaces of solid parts which are in relative motion such as air bearing, magnetic bearings, liquid bearings or other means of holding the parts position without direct contact and by using brushless motors capable of high speed operation.

The invention claimed is:

1. A heat pump system comprising:

a hot side heat exchanger that defines an inlet port and an outlet port, the hot side heat exchanger configured to exchange heat with ambient air on a hot side of the heat pump system;

a cold side heat exchanger that defines an inlet port and an outlet port;

a means for expanding gas and extracting work from expansion of gas, the means for expanding having an inlet port and an outlet port, the inlet port of the means for expanding coupled to the outlet port of the hot side heat exchanger, and the outlet port of the means for expanding coupled to the inlet port of the cold side heat exchanger;

a means for compressing gas coupled to the means for expanding, the means for compressing utilizing at least some of the work extracted by the means for expanding for compressing gas, the means for compressing having an inlet port and an outlet port, the inlet port of the means for compressing coupled to the outlet port of the cold side heat exchanger, and the outlet port of the means for compressing coupled to the inlet port of the hot side heat exchanger;

a means for adding mechanical work to the means for compressing gas, the means for adding mechanical work provides less than all the mechanical work used by the means for compressing gas; and a means for transporting heat from the cold side heat exchanger to the hot side heat exchanger through the means for compressing, the means for transporting heat moves within an internal flow path of the heat pump system;

the heat pump system comprises a closed cycle, the means for transporting heat has a constant total mass and constant total volume, and the means for transporting heat remains in gas phase throughout the heat pump system.

2. The heat pump system of claim 1 wherein the means for transporting heat further comprises at least one means for transporting heat selected from the group consisting of: air; neon; nitrogen; and helium.

3. The heat pump system of claim 1 further comprising:

a counter flow heat exchanger that defines a high pressure inlet port, a high pressure outlet port, a low pressure inlet port, and a low pressure outlet port;

the high pressure inlet port coupled to the outlet port of the hot side heat exchanger, the high pressure outlet port coupled to the inlet port of the means for expanding, the low pressure inlet port coupled to the outlet port of the cold side heat exchanger, and the low pressure outlet port coupled to the inlet port of the means for compressing;

wherein the counter flow heat exchanger is configured to reduce the temperature of the means for transporting heat exiting the high pressure outlet port of the counter flow heat exchanger to equal a cold side ambient air temperature; and wherein the counter flow heat exchanger is further configured to increase the temperature of the means for transporting heat exiting the low pressure outlet port of the counter flow heat exchanger to equal a hot side ambient air temperature.

4. The heat pump system of claim 1 wherein the means for expanding and the means for compressing comprises a double-acting piston.

5. The heat pump system of claim 1 wherein:

the means for expanding comprises a turbine; and the means for compressing comprises a compression wheel;

wherein the turbine is rotationally coupled to the compression wheel.

6. The heat pump system of claim 1 wherein:

the means for compressing comprises a rotary compressor; and the means for expanding has a drive shaft rotationally coupled to the rotary compressor, and the means for expanding comprises at least one selected from the group consisting of: a pneumatic motor; an air motor; a rotary air motor; and a rotary pneumatic motor.

7. The heat pump system of claim 1 wherein the heat pump system is configured to pump heat from the cold side heat exchanger to the hot side heat exchanger at any positive pressure difference between the hot side and the cold side.

8. The heat pump system of claim 7 further comprising:

a counter flow heat exchanger that defines a high pressure inlet port, a high pressure outlet port, a low pressure inlet port, and a low pressure outlet port;

the high pressure inlet port coupled to the outlet port of the hot side heat exchanger, the high pressure outlet port coupled to the inlet port of the means for expanding, the low pressure inlet port coupled to the outlet port of the cold side heat exchanger, and the low pressure outlet port coupled to the inlet port of the means for compressing;

the means for transporting heat further comprises at least refrigerant selected from the group consisting of air, neon, nitrogen, and helium;

the heat pump system is configured to have an Ideal Coefficient of Performance (ICOP) of 20 or higher.

9. The heat pump system of claim 1 wherein the total mass and total volume remains constant regardless of a pressure difference across the means for expanding.

10. A heat pump system comprising:

a hot side heat exchanger that defines an inlet port and an outlet port, the hot side heat exchanger configured to exchange heat with ambient air on a hot side of the heat pump system;

a cold side heat exchanger that defines an inlet port and an outlet port;

a means for expanding refrigerant, the means for expanding having an inlet port and an outlet port;

a means for compressing refrigerant, the means for compressing having an inlet port and an outlet port;

a counter flow heat exchanger that defines a high pressure inlet port, a high pressure outlet port, a low pressure inlet port, and a low pressure outlet port, the high pressure inlet port coupled to the outlet port of the hot side heat exchanger, the high pressure outlet port coupled to the inlet port of the means for expanding refrigerant, the low pressure inlet port coupled to the outlet port of the cold side heat exchanger, and the low pressure outlet port coupled to the inlet port of the means for compressing refrigerant; and a refrigerant within an internal flow path, the internal flow path comprising a path through the means for compressing refrigerant and the counter flow heat exchanger between the cold side heat exchanger and the hot side heat exchanger;

wherein the counter flow heat exchanger is configured to reduce the temperature of the refrigerant exiting the high pressure outlet port of the counter flow heat exchanger to equal a cold side ambient air temperature; and wherein the counter flow heat exchanger is further configured to increase the temperature of the refrigerant exiting the low pressure outlet port of the counter flow heat exchanger to equal a hot side ambient air temperature.

11. The heat pump of claim 10 wherein the refrigerant has a liquid phase caused by compression by the means for compressing refrigerant, wherein the liquid phase of the refrigerant passes through the counter flow heat exchanger, and a gas phase after expansion by the means for expanding refrigerant.

12. The heat pump of claim 10 wherein the refrigerant remains in a gas phase after compression by the means for compressing refrigerant.

13. The heat pump system of claim 12 wherein:

the means for expanding refrigerant comprises a turbine; and the means for compressing refrigerant comprises a compression wheel;

wherein the turbine is rotationally coupled to the compression wheel.

14. The heat pump system of claim 12 wherein the means for expanding refrigerant and the means for compressing refrigerant comprise a double-acting piston.

15. The heat pump system of claim 12 wherein:

the means for compressing refrigerant comprises a rotary compressor; and the means for expanding refrigerant has a drive shaft rotationally coupled to the rotary compressor, and the means for expanding comprises at least one selected from the group consisting of: a pneumatic motor; an air motor; a rotary air motor; and a rotary pneumatic motor.

16. The heat pump system of claim 12 wherein the refrigerant further comprises at least one selected from the group consisting of: air; neon; nitrogen; and helium.

17. The heat pump system of claim 10 further comprising a means for reversing roles of the heat exchangers such that the hot side and cold side heat exchangers become the cold side and hot side heat exchangers, respectively, and the means for reversing roles leaves the flow through the means for expanding, means for compressing, and counter flow heat exchanger unchanged.

18. A heat pump system to control temperature in a temperature-controlled space, the heat pump system comprising:

a first heat exchanger that defines an inlet port and an outlet port, the first heat exchanger configured to exchange heat with ambient air outside the temperature-controlled space;

a second heat exchanger that defines an inlet port and an outlet port, the second heat exchanger configured to exchange heat with air inside the temperature-controlled space;

a means for expanding refrigerant and extracting work from expansion of refrigerant, the means for expanding having an inlet port and an outlet port, the inlet port of the means for expanding coupled to the outlet port of the first heat exchanger, and the outlet port of the means for expanding coupled to the inlet port of the second heat exchanger;

a means for compressing refrigerant coupled to the means for expanding, the means for compressing utilizing at least some of the work extracted by the means for expanding for compressing refrigerant, the means for compressing having an inlet port and an outlet port, the inlet port of the means for compressing coupled to the outlet port of the second heat exchanger, and the outlet port of the means for compressing coupled to the inlet port of the first heat exchanger;

a motor coupled to the means for expanding and the means for compressing, the motor configured to add less than all mechanical work used by the means for compressing;

a counter flow heat exchanger that defines a high pressure inlet port, a high pressure outlet port, a low pressure inlet port, and a low pressure outlet port, the high pressure inlet port coupled to the outlet port of the first heat exchanger, the high pressure outlet port coupled to the inlet port of the means for expanding refrigerant, the low pressure inlet port coupled to the outlet port of the second heat exchanger, and the low pressure outlet port coupled to the inlet port of the means for compressing refrigerant; and a refrigerant with an overall volume, the refrigerant within an internal flow path, the internal flow path comprising a path through the means for compressing refrigerant and the counter flow heat exchanger between the second heat exchanger and the first heat exchanger, the refrigerant remains in a gas phase after compression by the means for compressing gas and after expansion by the means for expanding, and the overall volume remains constant regardless of a pressure difference across the means for expanding;

wherein the counter flow heat exchanger is configured to reduce the temperature of the refrigerant exiting the high pressure outlet port of the counter flow heat exchanger to equal temperature of air in the temperature-controlled space; and wherein the counter flow heat exchanger is further configured to increase the temperature of the refrigerant exiting the low pressure outlet port of the counter flow heat exchanger to temperature of ambient air outside the temperature-controlled space;

a valve system configured to reverse direction of heat movement of the heat pump system, the valve system leaves the refrigerant flow through the means for expanding, means for compressing, and counter flow heat exchanger unchanged, in a first configuration of the valve system heat is moved from the temperature controlled space to outside the temperature-controlled space, and in a second configuration heat is moved from outside the temperature-controlled space to inside the temperature-controlled space; and the heat pump system is configured to have an Ideal Coefficient of Performance (ICOP) of 20 or higher.

19. The heat pump system of claim 18 wherein:

the means for expanding refrigerant comprises a turbine; and the means for compressing refrigerant comprises a compression wheel;

wherein the turbine is rotationally coupled to the compression wheel.

20. The heat pump system of claim 18 wherein the means for expanding refrigerant and the means for compressing refrigerant comprise a double-acting piston.

21. The heat pump system of claim 18 wherein:

the means for compressing refrigerant comprises a rotary compressor; and the means for expanding refrigerant has a drive shaft rotationally coupled to the rotary compressor, and the means for expanding comprises at least one selected from the group consisting of: a pneumatic motor; an air motor; a rotary air motor; and a rotary pneumatic motor.

22. The heat pump system of claim 18 wherein the refrigerant further comprises at least one selected from the group consisting of: air; neon; nitrogen; and helium.

* * * * *